US012227882B2

(12) United States Patent
Anderegg et al.

(10) Patent No.: US 12,227,882 B2
(45) Date of Patent: Feb. 18, 2025

(54) CARDER

(71) Applicant: Maschinenfabrik Rieter AG, Winterthur (CH)

(72) Inventors: Peter Anderegg, Winterthur (CH); Christian Sauter, Flurlingen (CH); Thomas Walther, Winterthur (CH)

(73) Assignee: Maschinenfabrik Rieter AG, Winterthur (CH)

( * ) Notice: Subject to any disclaimer, the term of this patent is extended or adjusted under 35 U.S.C. 154(b) by 12 days.

(21) Appl. No.: 18/166,162

(22) Filed: Feb. 8, 2023

(65) Prior Publication Data

US 2023/0257914 A1 Aug. 17, 2023

(51) Int. Cl.
*D01G 15/36* (2006.01)
*D01G 15/16* (2006.01)
*D01G 15/32* (2006.01)

(52) U.S. Cl.
CPC ..... *D01G 15/36* (2013.01); *D01G 15/16* (2013.01); *D01G 15/32* (2013.01)

(58) Field of Classification Search
CPC ..... D01G 15/36; D01G 15/28; D01G 15/18; D01G 15/16; D01G 31/006; D01G 31/00; G01H 1/003
USPC ..... 700/142, 143
See application file for complete search history.

(56) References Cited

U.S. PATENT DOCUMENTS

2002/0050027 A1* 5/2002 Leder ..... D01G 15/28 19/103
2007/0033917 A1* 2/2007 Pferdmenges ..... D01G 15/28 57/264
2007/0089275 A1* 4/2007 Breuer ..... D01G 15/28 19/54
2007/0266528 A1* 11/2007 Farber ..... D01G 15/28 19/98
2008/0220695 A1* 9/2008 Kamphausen ..... D01G 15/38 451/131
2017/0146989 A1* 5/2017 Locatelli ..... G05B 23/0283
2020/0027339 A1 1/2020 Gutberlet et al.

FOREIGN PATENT DOCUMENTS

| | | | |
|---|---|---|---|
| CH | 695 351 | A5 | 4/2006 |
| DE | 39 13 996 | A1 | 8/1990 |
| DE | 42 35 610 | A1 | 4/1994 |
| DE | 69600589 | T2 | 1/1999 |
| DE | 102 51 574 | A1 | 5/2004 |
| DE | 102005050904 | A1 | 4/2007 |
| DE | 10 2006 002 812 | A1 | 7/2007 |

(Continued)

OTHER PUBLICATIONS

Swiss Patent Office Search Report, Mar. 24, 2022.

*Primary Examiner* — Aiying Zhao
(74) *Attorney, Agent, or Firm* — Dority & Manning, P.A.

(57) ABSTRACT

A carder includes a machine frame, a controller, and a drum provided with a clothing on an outer surface thereof. Working elements are disposed relative to the outer surface of the drum. The drum includes two stub axles or a continuous axial along a longitudinal axis thereof, the continuous axle having a first end and an opposite second end and each of the stub axles having an outer end face. An acceleration sensor that measures structure-borne sound is mounted on the end face of at least one of the stub axles or on the first end of the continuous axle.

12 Claims, 2 Drawing Sheets

(56) References Cited

FOREIGN PATENT DOCUMENTS

| | | | | | |
|---|---|---|---|---|---|
| DE | 102007005601 | A1 | | 11/2007 | |
| DE | 102018010156 | A1 | | 7/2020 | |
| EP | 3354774 | A1 | * | 8/2018 | ..... D01G 15/08 |
| RU | 30756 | U | | 7/2003 | |
| RU | 30756 | U1 | * | 7/2003 | |
| WO | WO-2018215885 | A1 | * | 11/2018 | ..... D01G 15/16 |

* cited by examiner

CARDER

FIELD OF THE INVENTION

The present invention relates to a carder having a drum with a longitudinal axis, a circumference and a length, wherein the drum is provided with clothing on its outer surface. The carder has elements which are arranged vis-à-vis the outer surface of the drum. The drum is designed as a hollow cylinder with a drum wall and, along the longitudinal axis, is formed with at least two stub axles or a continuous axle, wherein the stub axle or the axle is connected to the drum wall by spokes or disks.

BACKGROUND

In a carder, the revolving flats region together with the drum forms the main carding zone, and its function is to break up clusters of fibers to form individual fibers, separate out impurities and dust, eliminate very short fibers, break up neps, and parallelize the fibers. Depending on the use of a carder, fixed flats, revolving flats, or a mixture of fixed and revolving flats are used. A narrow gap, which is called the carding gap, forms between the clothing (needle tips) of the revolving flat and the clothing (saw tooth) of the drum. It results when revolving flats are used, in that the revolving flats, guided by arc-shaped strips—so-called flexible sheets, regulating sheets, flex sheets or sliding sheets—are guided along the circumference of the drum at a distance determined by these strips. With a revolving flat carder, the size of the carding gap is typically between 0.10 to 0.30 mm for cotton, or up to 0.40 mm for synthetic fibers. However, contact with the vis-à-vis situated elements is to be avoided since this can routinely cause damage to the traveling flats as well as to the drum. As a result, determining the actual carding gap is of great importance.

In order to achieve a carding effect as efficient as possible in a carder, it is necessary to keep the carding gap as small as possible, in particular in the main carding zone between the clothing of the revolving flat and the clothing of the drum. The clothing of the drum is applied on the outer surface of the drum of the carder by special tightening methods and fastening methods. In order to achieve high production quantities, the rotational speeds of the drums have been increased more and more in recent years. That is, drums with rotational speeds of over 600 rpm have now come into use. By increasing the rotational speeds, the centrifugal forces on the drum of the carder are increased, which cause non-uniform elastic deformations in the diameter region of the drum of the carder due to the arising non-uniform stresses. As a result of the arising described non-uniform elastic deformations occurring in the drum region, the carding gap that arises in the idle state can change in the operating state, which can lead to impairments of the carding due to loss of carding surface, as well as to collisions of the clothings and therefore to damage to the clothings. The basis for setting the carding gap is the knowledge of when it is zero, i.e. contact with the vis-à-vis positioned components takes place. In this way, available adjustment devices can be easily calibrated. By precisely determining this contact, exact maintenance of the carding gap can on the one hand be achieved, and damage to the components can on the other hand be avoided.

Various devices and methods are known for determining the carding gap, or contact with the oppositely situated components. For example, DE 10 2006 002 812 A1 describes a device and a corresponding method for determining the carding gap. In the case of a spinning preparation machine, in particular a carder, rolling carder or the like, for monitoring and/or adjusting distances and components, in which a clothed, fast-rotating roller is situated opposite at least one clothed and/or non-clothed component, and the distance between the mutually opposite components can be changed, are electrically insulated from one another. These components are connected to an electrical circuit as respective contact elements, in which electrical circuit there is a measuring element for determining contact. The clothed, fast-rotating roller is, for example, a drum of a carder, wherein the oppositely situated, clothed and/or non-clothed component is, for example, a take-off roller, a revolving flat, or a cladding segment having a guide surface. The so-called carding gap is located between the roller and the component that is at a distance. This carding gap is very narrow and can change, for example during operation of the machine, by the components becoming heated. In this case, contact can occur between the rapidly rotating roller and the oppositely situated component. Such contacts are to be avoided as far as possible.

In DE 10 2006 002 812 A1, it is accordingly proposed as a remedy to avoid undesirably frequent contact between the components, and therefore damage to the clothing, by determining the quantity of contacts, therefore avoiding a notification or reaction when there is only one such contact, or only a slight contact. In particular, an undesired shutdown of the machine is thereby avoided. In order to achieve this, an evaluation of the number of contacts having a certain contact duration, for example a contact duration of 0.1 ms, 1 ms or 2 ms, is filtered. For this purpose, there is a counting device which determines the number of contacts between a card clothing and a clothing strip per unit of time. This number or quantity of contacts is used for further evaluation and for the resulting reaction, for example for stopping the carder or for further operation of the carder.

Furthermore, CH 695 351 A5 discloses a device for determining contact between two components. Contact between the tips of the clothing of the countersurface, formed as at least one revolving flat bar, and the tips of the clothing of the roller, formed as a drum, can be brought about by displacing the revolving flat bars; this contact can be determined by a sensor device, wherein sound measurement of a structure-borne sound transmitted to the machine or a resistance or current measurement in a circuit applied through the contacting components is used to determine the contact.

Various contactless measuring methods and corresponding devices for determining the distance or contact of clothing tips in textile machines are also known. Thus, for example, DE 42 35 610 A1 discloses an inductive sensor that is assigned to the revolving flat of a carder and is situated opposite the clothing of the drum. DE 102 51 574 A1 describes an optical sensor which is capable of acquiring the distance between the free ends of the clothings and corresponding reference surfaces. DE 39 13 996 A1 also discloses contactless sensors, wherein capacitive, inductive, and optical sensors are mentioned.

Indirect measurement methods may also be used. Indirect measurement methods are those in which the immediate distance of the oppositely situated clothing tips is not measured. An example of this is described in DE 42 35 610 A1, cited above, which discloses a distance measurement of the clothing of the drum from a revolving flat bar in which only the sensors are accommodated. According to DE 39 13 996 A1, sensors are provided on the end faces of the clothings, which are assigned to the drum and which measure the distance to oppositely situated counterpieces on the revolving flat. It is also known to determine the distance between the sliding shoes, which are attached to the revolving flat bars via revolving flat heads, and the revolving flat clothing. The immediate distance to the clothing tips is then deduced from these indirect distance measurements, whereby contact can be determined.

The known methods and measuring methods have the disadvantage that contact is determined only with a large technical outlay.

SUMMARY OF THE INVENTION

An object of the invention is to overcome the disadvantages of the prior art and to enable a determination of a contact of two oppositely situated components, or clothings, with high accuracy. Additional objects and advantages of the invention will be set forth in part in the following description, or may be obvious from the description, or may be learned through practice of the invention.

The objects are achieved by the features of the invention described and claimed herein.

A novel carder is proposed having a machine frame and having a controller, and having a drum provided with a clothing on its outer surface, and having working elements which are arranged vis-à-vis the outer surface of the drum. The drum is formed in a longitudinal axis, with two stub axles or with a continuous axle having a first end and a second end oppositely situated in the longitudinal axis. An acceleration sensor for measuring structure-borne sound is attached at the end face to at least one of the stub axles or at least one end of the axle. The acceleration sensor is therefore attached to a rotating element, wherein the element executes a rotational movement synchronous with the outer surface of the drum. The structure-borne sound resulting from the moving components is measured by the acceleration sensor. When the moving components or their surfaces or clothings come close to one another, the components and the air in the immediate vicinity of the components are made to vibrate. This vibration is conducted by the components and is referred to as structure-borne sound. For example, contact between a working element of the clothing (saw teeth) of the drum produces a characteristic noise. If the working element is realized as a revolving flat with clothing formed by needles, structure-borne sound is generated as soon as there is contact between individual needles of a clothing of a revolving flat and individual saw teeth of the clothing of the drum. The intensity and the frequency of this structure-borne sound are dependent on various machine and process parameters, such as: a speed of the components themselves or relative to one another, the type, shape and nature of the surfaces of the components, the material of the components and, not least, also the actual contact of the components moving past each other. In particular, the periodicity of the sawtooth clothing of the drum, the drum rotational speed, and the drum radius are determining factors for the intensity (amplitude) and frequency.

The structure-borne sound is caused when the needles of the revolving flat assembly contact the saw teeth of the drum clothing. In order to detect the best possible signal, it is advantageous if the structure-borne sound sensor is attached as close as possible to the point of origin of the structure-borne sound. All transitions and especially bearings act as a filter for the structure-borne sound, as a result of which only a portion of the actually generated structure-borne sound can be acquired by the sensor. In addition, there are bearing noises which cause a basic noise level. By filtering the sound emissions measured in the form of structure-borne sound, it is possible to eliminate the structure-borne noise of the bearing noises or other components of the carder so that contact can be detected.

Because the provided arrangement of the acceleration sensor on one of the stub axles or at one end of the axle, the acceleration sensor is attached to a rotating element. As a result, the structure-borne sound produced at the circumference of the drum has to overcome no or few material transitions between the location of its production and the location of the measurement, as a result of which interfering noises, such as those that arise for example due to the bearing, can be largely masked out. An attachment of the acceleration sensor to the rotating element also has the advantage that the measurement of the structure-borne sound always takes place at the same position with respect to the outer surface of the drum, and one can thereby determine where the contact has taken place with respect to the outer surface.

As a result of the fact that the acceleration sensor is fastened directly on the axle or on the stub axle, a transition from a rotating element to a stationary element, which has to pass through the structure-borne sound, is avoided. A further acceleration sensor is advantageously arranged on the second stub axle or on the second end of the axle. An arrangement of a plurality of acceleration sensors promotes an error-free determination of contacts. A doubling of the number of acceleration sensors enables the detection of minimal contacts, for example a touching of a single needle of a revolving flat clothing with a tip of a saw tooth of the drum clothing. This makes it possible to detect minute contacts of the two clothings and to initiate corresponding countermeasures.

By equipping the drum drive with a rotational angle measurement by a so-called index sensor, the position of the sensors relative to the machine can be acquired during each individual revolution of the drum. For each revolution of the drum, the index sensor indicates the position (azimuth) 0°. Therefore, at all times an exact position of the sensors is known, measured at an angle of rotation about the longitudinal axis of the drum. In this way, when contact occurs, it can for example be determined, through a corresponding evaluation of the measurements of the structure-borne sound, which of the revolving flat bars running along a surface of the drum caused this contact. It is also possible to determine whether the measured contacts took place due to an uneven expansion of the drum.

Likewise, the position can be located not only over the circumference of the drum, but also along its length. This is achieved by arranging the two acceleration sensors at opposite ends of the axle or on oppositely-situated stub axles. In this way, it can be determined for example that, due to a bending of the revolving flat bars resulting for example from excessive temperature development, a contact of the clothing of the revolving flat bars with the drum clothing in a certain region of the length of the drum has taken place or become more frequent.

Preferably, the acceleration sensors have a measurement range from 10 kHz to 500 kHz. It has been determined empirically that the structure-borne sound generated by contacts between the needles of the revolving flat bars and the clothing of the drum is in a range from 10 kHz to 300 kHz. A larger measurement range would mean a correspondingly higher outlay with respect to filters, in order to eliminate the interfering noises. Preferably, an evaluation is provided in a range of 10 kHz to 300 kHz. In a spectral analysis, a main component of the structure-borne sound generated by the contacts of needles and saw teeth is evaluated in a frequency range of 10 to 30 kHz.

An evaluation unit is advantageously provided that, when a specified sound level is exceeded, provides a display for visualizing and forwarding a signal to a controller of the carder. The evaluation unit records the signals of the acceleration sensors and evaluates them such that actual contact between the components can be recognized. The evaluation unit is advantageously fixed positionally and rotationally to the machine frame. The closer to the measurements the evaluation unit is attached, the easier the evaluation itself is.

The signal from the acceleration sensor to the evaluation unit can be transmitted conventionally via a sliding contact. However, it is advantageous if a wireless signal transmission is provided between the acceleration sensor and the evaluation device. When there is a wireless transmission, there is no wear of the transmission elements, and the equipment can be used without maintenance. In addition, this arrangement provides the reliability of a wired signal transmission of the evaluated measurement signal to the controller.

The same principle applies to the necessary energy supply of the acceleration sensors and the evaluation unit. The energy can likewise be supplied conventionally via sliding contacts. However, it is advantageous if an energy supply to the acceleration sensors and/or the evaluation device is provided by an open, rotating transformer or an open electric motor. These energy supplies between stationary and rotating components are prior art and have proven themselves in use. However, it is advantageous if inductive energy transmission is provided by wireless charging modules. Wireless charging modules use an electromagnetic field to transmit energy between two objects. The energy is sent via an inductive coupling to an electrical device which can then use this energy for charging batteries or for operating the device.

Through a corresponding evaluation of the measurements of the structure-borne sound, contacts between the surface of the drum, or the clothing on the surface, and a wide range of components situated vis-à-vis the drum can be determined. In this case, the components vis-à-vis the drum may be designed as blades, guide plates, carding elements, revolving flats, or clothed rollers.

Furthermore, it is advantageous if an input device and/or a detection device is provided for inputting or identifying the clothing type of the clothing of the drum, the surface structure of the vis-à-vis situated parts, and/or of production-dependent variables, in particular the production rate, the type and/or the moisture of the fibers. This improves the evaluation of the measurement of the structure-borne sound. The controller, or its software, can take into account these factors influencing the structure-borne noise production when evaluating the results of the measurements of the acceleration sensors, and can accordingly generate a more accurate signaling of potential hazards. In particular, the periodicity a sawtooth clothing of the drum, a drum speed, and a drum radius are determinative for the intensity (amplitude) and frequency.

In addition, a method for operating a carder designed according to the above description is proposed. From the measured structure-borne sound, a sound level is formed in an evaluation unit, and a contact of the clothing of the drum with the vis-à-vis situated working element is determined.

Preferably, when an upper limit level is exceeded or if a certain duration of a lower limit level is exceeded, the carder is switched off. It is advantageous to predict possible crashes in order to be able to react accordingly so as to prevent or minimize machine damage. With structure-borne sound monitoring, this is possible under corresponding conditions. Strong structure-borne noise is caused by a crash. If the sound amplifier or the evaluation is set so that, during normal operation, the crash threshold is not exceeded, the corresponding output can be used as crash detection. The corresponding input of the machine controller has to be fast in order to react accordingly, for example by switching off a material feed, reducing the rotational speed, or disconnecting the drum or lifting the component situated vis-à-vis the drum. If a lower limit level is permanently undershot, it is to be concluded that either no carding is taking place or the acceleration sensors have failed. For safety reasons, the carder is also switched off in such a case, since it is no longer ensured that problematic contact can be detected in good time.

BRIEF DESCRIPTION OF THE DRAWINGS

Further advantages of the invention are described in the following exemplary embodiments. In the drawings.

DETAILED DESCRIPTION

Figure 1:
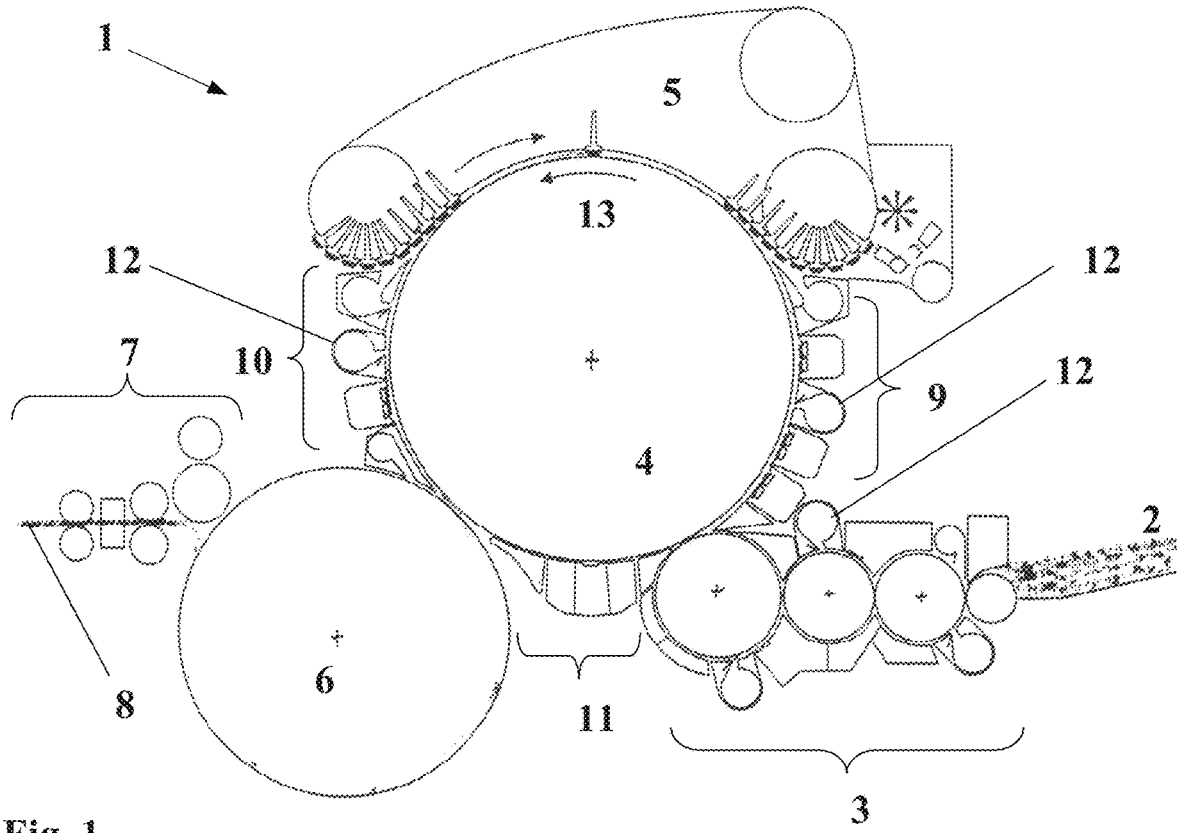
FIG. 1 shows a schematic representation of a carder according to the prior art.

Reference will now be made to embodiments of the invention, one or more examples of which are shown in the drawings.

FIG. 1 shows, in a schematic representation, a carder 1 according to the prior art. After it has passed through various blowroom process stages, fiber material 2 moves into a licker-in 3. The fiber material 2 is opened by the rollers and working elements 12 contained in the licker-in 3, and at the same time is freed of a portion of the impurities contained therein. The last roller of the licker-in 3 transfers the fiber material finally to the drum 4 of the carder 1, which completely separates the fiber material into individual fibers, cleans it, and parallelizes it. For this purpose, the drum 4 cooperates with traveling flats 5 and other various working elements 12. The drum 4 is moved in a direction of rotation 13 and guides the fibers from the licker-in 3 to the doffer 6. In so doing, the fibers are conveyed through a pre-carding zone 9, subsequently past the revolving flats 5, and then via a post-carding zone 10 to the doffer 6. Working elements 12 are used both in the pre-carding zone 9 and in the post-carding zone 10. Among other things, carding elements for parallelizing the fibers and separating elements for separating trash parts and short fibers are used as working elements 12 in the pre-carding zone 9 and the post-carding zone 10. Between the doffer 6 and the licker-in 3, the fiber material remaining on the drum passes through a sub-carding zone 11, as seen in the direction of rotation 13 of the drum 4. Currently, usually no separating elements are used in the sub-carding zone 11. After the fibers have carried out a plurality of revolutions on the drum 4, they are removed from the drum 4 by the doffer 6 in the form of fiber mat, and are reshaped with a sliver forming unit 7 to form a card sliver 8. The card sliver 8 is then placed into a can for further transport (not shown).

Figure 2:
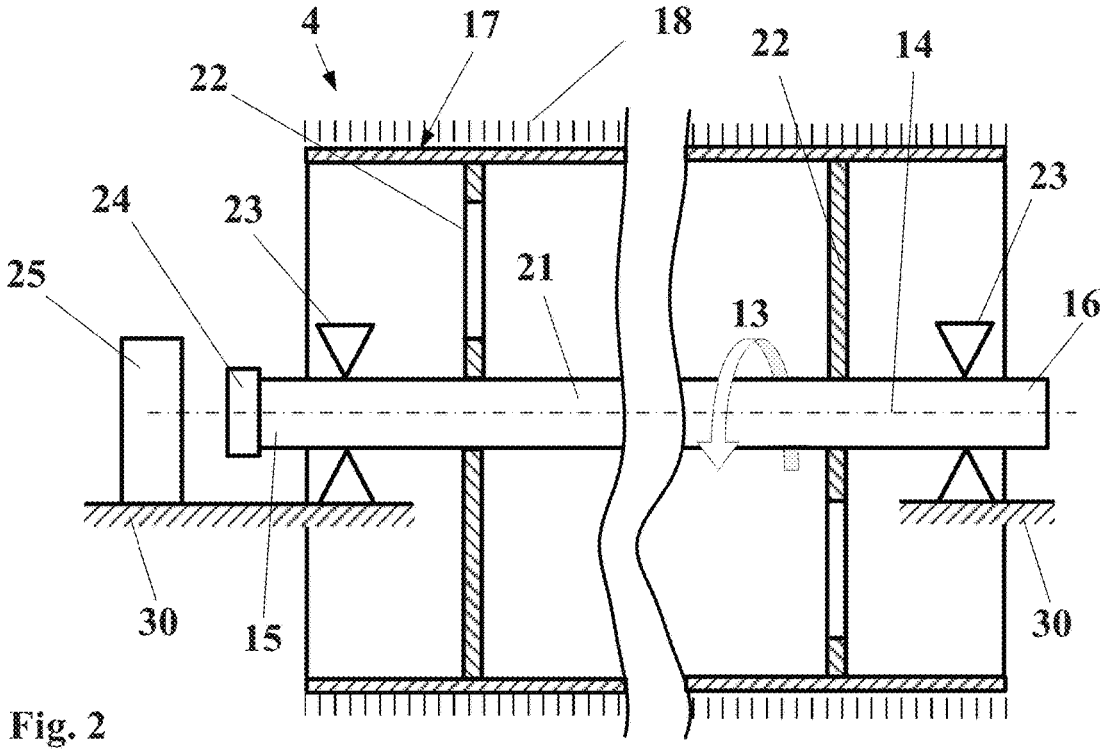
FIG. 2 shows a schematic representation of a drum according to the invention in a first embodiment.

FIG. 2 shows a schematic representation of a drum 4 according to the invention in a first embodiment. The drum 4 is designed as a hollow cylinder with a longitudinal axis 14 and an outer surface 17. To support the hollow cylinder, two spokes 22 are introduced into the hollow cylinder, which connect the hollow cylinder to an internal axle 21 that extends through the entire longitudinal axis 14 of the drum 4. A bearing 23 of the drum 4 is provided at both axle ends 15 and 16. In these bearings 23, the drum 4 is held in a machine frame 30 and, during operation, rotates in the direction of rotation 13. A clothing 18 is applied on the outer surface 17 of the drum. Such clothings 18 are usually designed as sawtooth clothings and are wound onto the drum 4 in wire form. An acceleration sensor 24 for measuring structure-borne sound is attached at the end face at the first axle end 15. An evaluation unit 25 held in the machine frame 30 is provided vis-à-vis the acceleration sensor 24 mounted on the end face on the rotating axle 21. The measurement values from the acceleration sensor 24 are transmitted wirelessly to the evaluation unit 25. At the same time, the energy required for operation is transmitted to the acceleration sensor 24 via an electromagnetic field.

Figure 3:
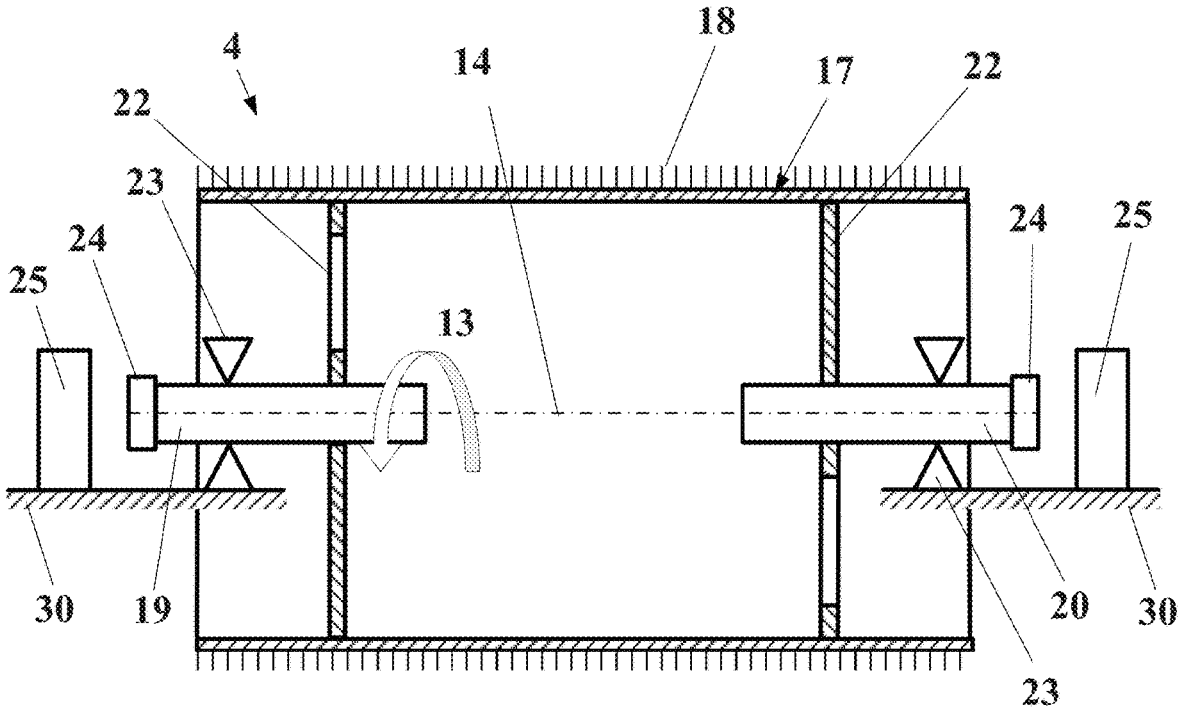
FIG. 3 shows a schematic representation of a drum according to the invention in a second embodiment.

FIG. 3 shows a schematic representation of a drum 4 according to the invention in a second embodiment. The drum 4 is designed as a hollow cylinder with a longitudinal axis 14 and an outer surface 17. In order to support the hollow cylinder, two spokes 22 are introduced into the hollow cylinder, which connects the hollow cylinder to two interior stub axles 19 and 20 arranged in the longitudinal axis 14. A bearing 23 of the drum 4 is provided on both stub axles 19 and 20. In these bearings 23, the drum 4 is held in a machine frame 30 and, during operation, rotates in the direction of rotation 13. A clothing 18 is applied on the outer surface 17 of the drum. On the first stub axle and on the second stub axle 16, one acceleration sensor 24 each is mounted on the end face for measuring a structure-borne sound. An evaluation unit 25 held in the machine frame 30 is respectively provided vis-à-vis the acceleration sensors 24 mounted on the end faces on the rotating stub axles 19 and 20. The measurement values from the acceleration sensors 24 are transmitted wirelessly to the evaluation units 25. At the same time, the energy required for operation is transmitted to the acceleration sensors 24 via an electromagnetic field.

Figure 4:
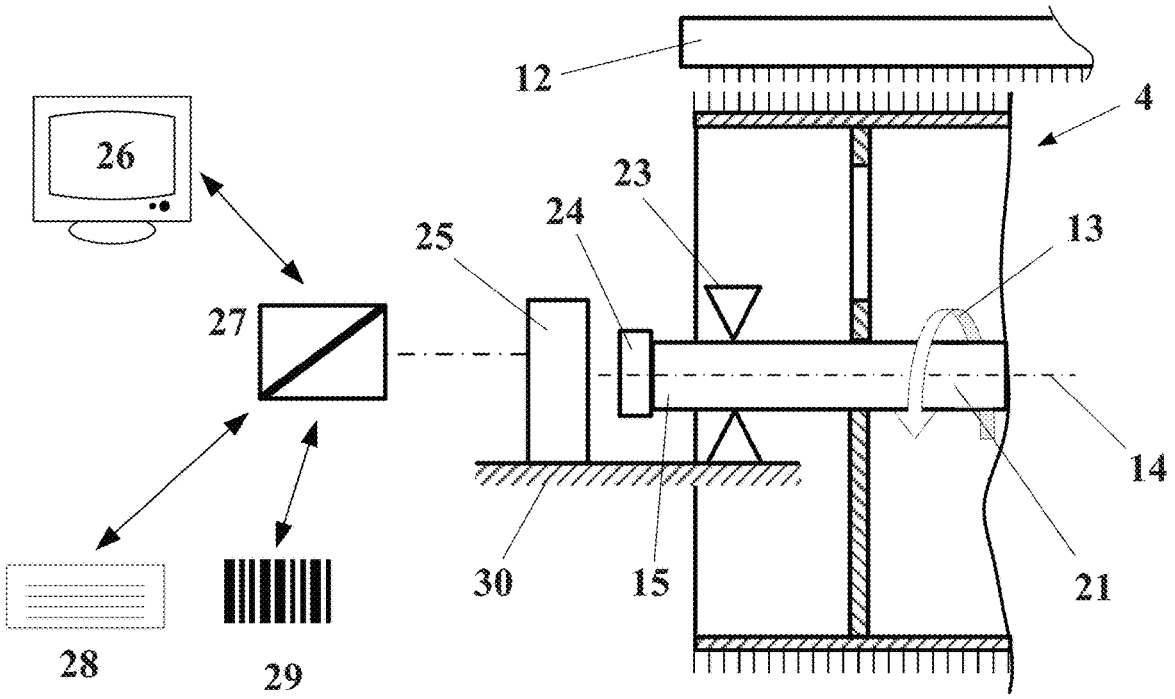
FIG. 4 shows a schematic representation of a configuration of the method according to the invention.

FIG. 4 is a schematic view of a method configuration according to the invention. The drum 4 is identical, in its design and the configuration of axle 21, bearing 23, acceleration sensor 24, and evaluation unit 25, to the embodiment according to FIG. 2, and reference is therefore made to the description relating to FIG. 2. The acceleration sensor 24 moves together with the drum 4 about the longitudinal axis 14 in the direction of rotation 13. The measurement signals from the acceleration sensor 24 are transmitted wirelessly to the evaluation unit 25 held in a stationary manner in the machine frame 30. The evaluated measurement signals are transmitted from the evaluation unit 25 to a controller 27 by wire, or for example via WiFi.

The controller 27 is connected to a display 26 and to an input device 28. The display 26 is activated by the controller 27 as soon as an unexpected situation results from the evaluation of the acceleration sensor 24. If, for example, a sound level is exceeded because the clothing 18 has contacted a working element 12 situated vis-à-vis the clothing 18. The target values or limit values of the structure-borne sound measurement stored in the controller 27 can be accessed via an input device 28. In order to achieve an improvement in structure-borne sound measurement, the components used on the drum 4, such as for example the type of the clothing 18 of the drum 4, the surface structure of the vis-à-vis situated working elements 12, can be transmitted to the controller 27 via the input device 28. Furthermore, it is also possible to input production-dependent variables, in particular the production rate, the type and/or the moisture of the fibers. In the case of a more advanced automation of the carder, a detection device 29, which recognizes the employed components of the drum 4, is linked to the controller 27. For example, via a barcode recognition, when working elements 12 are exchanged, the properties thereof, or also the properties of the fibers to be processed, can be read directly into the controller 27 without the input device 28 having to be used.

The present invention is not limited to the shown and described embodiments. Modifications within the scope of the claims are possible, as well as a combination of the features, even if these are shown and described in different embodiments.

KEY 1 carder
2 fiber material
3 licker-in
4 drum
5 revolving flat
6 doffer
7 sliver-forming unit
8 fiber sliver
9 pre-carding zone
10 post-carding zone
11 sub-carding zone
12 working element
13 direction of rotation
14 drum longitudinal axis
15 first end of the axle
16 second end of the axle
17 drum surface
18 drum clothing
19 first stub axle
20 second stub axle
21 axle
22 spoke
23 bearing
24 acceleration sensor
25 evaluation unit
26 display
27 controller
28 input device
29 recognition/detection device
30 machine frame

The invention claimed is:

1. A carder, comprising:

a machine frame;

a controller;

a drum provided with a clothing on an outer surface thereof;

working elements disposed relative to the outer surface of the drum;

the drum comprising two stub axles or a continuous axial along a longitudinal axis thereof, the continuous axle comprising a first end face and an opposite second end face and each of the stub axles having an outer end face; and an acceleration sensor that measures structure-borne sound mounted on the outer end face of at least one of the stub axles or on the first end face of the continuous axle so as to rotate with the at least one stub axle or the continuous axle.

2. The carder according to claim 1, comprising an additional acceleration sensor mounted on the outer end face of the other stub axle or on the second end face of the continuous axle.

3. The carder according to claim 1, wherein the acceleration sensor comprises a measurement range from 10 KHz to 500 KHz.

4. The carder according to claim 1, further comprising an evaluation unit in communication with the acceleration sensor and configured to provide a visual display when a specific sound level is exceeded and to forward a signal to the controller.

5. The carder according to claim 4, wherein the evaluation unit controller provides an evaluation in a range of 10 KHz to 300 KHz.

6. The carder according to claim 4, wherein the evaluation unit is positionally and rotationally fixed to the machine frame.

7. The carder according to claim 4, wherein the evaluation units is in wireless communication with the acceleration sensor.

8. The carder according to claim 4, further comprising an inductive energy supply to the acceleration sensor and the evaluation unit.

9. The carder according to claim 1, wherein the working elements comprise one or more of: blades, guide plates, carding elements, revolving flats, or clothed rollers.

10. The carder according to claim 1, further comprising an input device or a detection device in communication with the controller to input or automatically recognize one or more of: a type of the clothing, a surface structure of the working elements, or production-dependent variables.

11. A method for operating the carder according to claim 1, comprising determining and evaluating a sound level from structure-borne sound detected by the acceleration sensor and determining a contact of the clothing with one or more of the working elements based on the sound level.

12. The method according to claim 11, comprising switching off the carder when an upper limit level of the sound level is exceeded or a specified duration of a lower limit level of the sound level is exceeded.

* * * * *